US011141672B2

(12) United States Patent
Hebe

(10) Patent No.: US 11,141,672 B2
(45) Date of Patent: Oct. 12, 2021

(54) FOIL BALLOON ADAPTER PART, FOIL BALLOON AND FOIL BALLOON AUTOMATIC DISPENSER

(71) Applicant: Frank Hebe, Horb-Muehringen (DE)

(72) Inventor: Frank Hebe, Horb-Muehringen (DE)

( * ) Notice: Subject to any disclaimer, the term of this patent is extended or adjusted under 35 U.S.C. 154(b) by 0 days.

(21) Appl. No.: 16/504,923

(22) Filed: Jul. 8, 2019

(65) Prior Publication Data

US 2019/0329143 A1 Oct. 31, 2019

Related U.S. Application Data

(63) Continuation-in-part of application No. PCT/DE2018/100940, filed on Nov. 19, 2018.

(30) Foreign Application Priority Data

Dec. 6, 2017 (DE) ..... 10 2017 128 979.8

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1083* (2013.01)

(58) Field of Classification Search
CPC ..... A63H 27/10; A63H 2027/1033; A63H 2027/1041; A63H 27/1083
See application file for complete search history.

(56) References Cited

U.S. PATENT DOCUMENTS 3,380,490 A * 4/1968 Ellenberg ..... G07F 11/00 141/167
3,536,110 A * 10/1970 West ..... G07F 13/02 141/137
4,088,161 A 5/1978 Ikemoto
4,094,267 A * 6/1978 Davis, Jr. ..... G09F 21/06 116/210
4,094,347 A * 6/1978 Ikemoto ..... A63H 27/10 141/313

(Continued)

FOREIGN PATENT DOCUMENTS

GB 191322229 A * 6/1914 ..... B64D 17/70
GB 144046 A * 6/1920 ..... B64D 17/78

OTHER PUBLICATIONS

English translation of the "International Search Report" for the corresponding International application No. PCT/DE2018/100940 dated Feb. 4, 2019 (2 pages).

(Continued)

*Primary Examiner* — Laura Davison
(74) *Attorney, Agent, or Firm* — Ronald S. Lombard

(57) ABSTRACT

In a foil balloon dispensing apparatus folded or rolled-up foil balloons are accommodated and are each provided with an adapter part including an attachment section connected to a foil balloon and a guide section which is removably connected to the attachment section and which is disconnected from the attachment section after the foil balloon is inflated but both sections remain attached to one another by a string wound up on the adapter part and connected to the attachment and guide sections for holding and guiding the foil balloon after its removal from the dispensing apparatus.

12 Claims, 18 Drawing Sheets

(56) References Cited

U.S. PATENT DOCUMENTS

| | | | | | |
|---|---|---|---|---|---|
| 4,687,458 | A | * | 8/1987 | Handa | A63H 27/10 446/220 |
| 4,836,128 | A | * | 6/1989 | Walker | B64B 1/50 116/210 |
| 5,020,467 | A | * | 6/1991 | Van Patten | B64B 1/50 116/210 |
| 5,370,161 | A | | 12/1994 | Shafer | |
| 6,109,203 | A | * | 8/2000 | Mears | B63C 9/0005 116/210 |
| 2007/0084878 | A1 | | 4/2007 | Handa | |

OTHER PUBLICATIONS

The English translation of the "Written Opinion of the International Searching Authority" for the corresponding international application No. PCT/DE2018/100940, (6 pages).

The "Written Opinion of the International Searching Authority" for the corresponding international application No. PCT/DE2018/100940, (7 pages), in the German language.

* cited by examiner

FOIL BALLOON ADAPTER PART, FOIL BALLOON AND FOIL BALLOON AUTOMATIC DISPENSER

CROSS-REFERENCE TO RELATED APPLICATIONS

This is a continuation-in-part application of pending international patent application PCT/DE2018/100940 filed Nov. 19, 2018 and claiming the priority of German patent application No. 10 2017 128 979.8 filed Dec. 6, 2017. Both the said international patent application PCT/DE2018/100940 and the said German patent application No. 10 2017 128 979.8 are incorporated herein by reference in their entireties as though fully set forth.

BACKGROUND OF THE INVENTION

The present invention concerns a foil balloon adapter part, a foil balloon with such an adapter part and a foil balloon dispensing apparatus.

Automatic sales and dispensing apparatus for latex balloons which are filled with helium are known. On demand, a selected desired latex balloon is filled in the sales and dispensing apparatus with helium to a predetermined internal pressure and is then dispensed. The balloons may be attached to a stick or they may be attached to a string.

Furthermore, foil balloons are known which are available in a multitude of shapes, colors and designs and which are filled by a salesperson with helium or another gas just before they are handed over to a customer or which are filled with a gas before they are offered for sale.

DE 1903215 A discloses an automatic dispensing apparatus for air balloons consisting of rubber where pressurized gas is introduced into the balloon via a valve insert and a nozzle. Then the balloon neck lifts off the outer surface of the valve body of the valve insert and clears openings to radial channels in the valve insert. As soon as the supply of pressurized gas is stopped the balloon neck returns to its position in tight contact with the outer surface of the valve body and, in this way, closes the openings of the radial passages to keep the gas in the balloon.

US 2007/0084878 A1 discloses an adapter part for a balloon which is to be filled with gas, wherein the adapter part includes a mounting ring, through which the end of the balloon via which the gas is to enter the balloon extends, as well as a guide ring which is arranged co-axially with the mounting ring for inflating the balloon. The gas balloon which is in the form of a foil balloon is provided in a dispensing apparatus in a folded state and is guided by the guide ring. When the gas balloon is inflated and dispensed from the dispensing apparatus the guide ring can be released from the mounting ring and the balloon can be held by a string connected thereto.

U.S. Pat. No. 4,088,161 also discloses a gas balloon which is guided in a dispensing apparatus via an adapter part and which is inflated in the apparatus before it is dispensed. The adapter part comprises a mounting ring which remains with the gas balloon as well as a guide ring by which the balloon can be held by a hand after the balloon is released from the dispensing apparatus. The mounting ring and the guide ring are interconnected by a string.

It is the object of the present invention to provide a dispensing apparatus capable of automatically filling balloons with a gas and dispensing them. In particular the dispensing apparatus should facilitate the automatic dispensing of a gas-filled balloon.

SUMMARY OF THE INVENTION

In a foil balloon dispensing apparatus folded or rolled-up foil balloons are accommodated and are each provided with an adapter part including an attachment section connected to a foil balloon and a guide section which is removably connected to the attachment section and which is disconnected from the attachment section after the foil balloon is inflated. But the two sections remain interconnected by a string for holding and guiding the foil balloon after its removal from the dispensing apparatus.

The foil balloons which are automatically filled with gas and dispensed by the dispensing apparatus according to the invention have a foil skin which is not, or only slightly, stretchable, contrary to a latex balloon. The foil balloons are disposed in the automatic dispensing apparatus folded or in the form of a roll and are unfolded or rolled off while they are filled with gas. The material of which the foil balloons consist is for example a plastic foil or an aluminum foil.

A first aspect of the invention concerns a foil balloon adapter part which can be attached to a foil balloon and via which gas can be supplied to the interior of the foil balloon. The adapter part has an attachment section for attachment to the balloon and a guide section which facilitates its guiding in a guide track of the dispensing apparatus. The attachment section and the guide section are interconnected. The attachment section and the guide section are each in the form of a hollow body and include an internal flow passage for the gas by which the foil balloon is inflated. The attachment section is further provided with a discharge opening for the gas.

The adapter part consists preferably of a plastic material and can be produced by a plastic injection molding process.

The design of the adapter part in the form of an attachment section and a guide section permits a function-specific adaptation of each section. The attachment section is formed so as to permit the attachment to, and the filling with gas of, the foil balloon. The guide section is provided for guiding the foil balloon within the dispensing apparatus during storage and during inflation of the balloon with gas. Both sections together form a continuous flow passage for the gas with which the foil balloon is being filled and which flows into the interior of the foil balloon via the discharge opening in the attachment section.

The attachment section can be connected to the foil balloon before its storage in the dispensing apparatus. Upon placement of the foil balloon into the dispensing apparatus the guide section is inserted into the respective guide track in which the adapter part is slidably supported. Advantageously, the guide section is accommodated form-fittingly in the guide track within the dispensing apparatus so as to be movable over the full length of the guide track. The adapter part has thereby multiple functions: first, to guide the foil balloon within the dispensing apparatus, second, to provide support during the filling of the foil balloon with gas, and finally to provide for a durable attachment to the foil balloon also outside the dispensing apparatus.

The attachment section and the guide section are releasably inter-connected that is the guide section and the attachment section are joined for storage within the dispensing apparatus and the filling of the balloon with gas but can be separated from one another upon discharge of the balloon from the dispensing apparatus. When separated from one another the attachment section and guide section are still inter-connected but only by a string so that the guide section can be held by a hand while the foil balloon is retained via the string connected to the attachment section. Consequently the guide section forms a handle part outside the dispensing apparatus.

The weight of the guide section plus the weight of the attachment section may be greater than the lifting capability of the helium-filled balloon. In this way it is ensured that the helium-filled balloon will not unintentionally fly off.

In an advantageous embodiment the releasable connection between the attachment section and the guide section includes a pre-set breaking point. Via the pre-set breaking point the attachment and the guide section are integrally interconnected but can be broken apart upon application of a predetermined separating force. But the two parts are still joined by the string. Such an interconnection by a breaking point has also the advantage that the two sections can be manufactured as a single part, preferably of a plastic material and can be manufactured in a single manufacturing step, preferably by a plastic material injection molding process.

The attachment section and the guide section which are interconnected by a string are, in accordance with a further advantageous embodiment of the invention, each provided with an annular winding groove for accommodating the string. During storage within the dispensing apparatus the string is accommodated in each of the winding grooves. When the attachment and guide sections are separated the string is partially or completely unwound from the winding grooves.

It is also possible to provide only a single winding groove, either on the attachment section or on the guide section, onto which the string is wound during storage of the foil balloon in the dispensing apparatus.

The pre-set breaking point may for example be provided along an annular wall which delimits a winding groove. Upon breaking of the pre-set breaking point the winding grooves should remain intact.

According to a further advantageous embodiment the attachment section includes a cone-shaped flow guide part. The flow passage for the gas with which the foil balloon is filled extends through the cone-shaped flow guide part. The cone-shape of the flow guide part facilitates the insertion of the tip of the flow guide part into the foil balloon or into a valve provided on the foil balloon.

In place of a conical flow guide part also flow guide parts of other geometric shapes with internal flow passages may be used, for example cylindrical parts.

In a further advantageous embodiment the flow guide part is provided at its tip with an axial projection which serves as an aid for the insertion of the flow guide part into a gas supply opening on the foil balloon or into a valve provided on the foil balloon.

In still a further advantageous embodiment the flow guide section is provided with an annular guide groove by which the flow guide section is guided in the guide track of the dispensing apparatus.

Advantageously, the guide track includes two individual tracks arranged at opposite sides of the annular guide groove in the guide section and between which the guide groove extends in a form-fitting manner.

In still another advantageous embodiment, the adapter part, in particular the guide section, is provided with one or several engagement arms for holding the foil balloon in the folded or rolled-up state. The engagement arms engage the non-filled foil balloon and securely hold it on the adapter part while it is stored in the dispensing apparatus. It is generally sufficient to provide only one engagement arm which, if necessary, may be relatively wide to apply to a folded packet of non-filled foil balloons a holding force over a relatively large area.

Also, two engagement arms may be used to ensure a better and more secure engagement of the foil balloon. The engagement arm or arms may be formed integrally with the adapter part. Additionally, or as an alternative, the adapter part may be cemented to the foil balloon.

A further aspect of the invention concerns a foil balloon which is provided with an adapter part as described earlier, wherein the attachment section of the adapter part is attached to the foil balloon and the outflow nozzle of the attachment section can be brought into flow connection with the interior of the foil balloon. The foil balloon may for example be provided with a valve into which the outflow nozzle extends. The balloon valve may be for example in the form of a spout check valve which automatically closes and retains the gas volume in the interior of the foil balloon. The pressure of the gas supplied via the attachment section moves the balloon valve from the closed to the open position in which the gas can flow into the foil balloon. As soon as the supply gas pressure drops below a predetermined limit valve the balloon valve closes again automatically.

The foil balloon can be connected to the attachment section of the adapter part by cementing, by a mechanical structure for example by means of a clamping ring or by welding, especially if the foil balloon consists of a plastic material.

In an advantageous embodiment, the foil balloon is provided with a projecting strap via which it may be connected to the attachment section of the adapter part. The balloon strap may be attached by means of the string. The balloon strap may possibly include an inflow opening for the gas to be conducted into the balloon.

A further aspect of the invention relates to an automatic foil balloon dispensing apparatus for accommodating and dispensing one or several of the balloons described earlier. The dispensing apparatus includes the described adapter parts. The dispensing apparatus may be in the form of an automatic sales apparatus which, after insertion of money or another payment method, dispenses a balloon filled with a gas. In the automatic dispensing apparatus preferably a multitude of foil balloons can be stored in a non-filled state. Upon demand, a foil balloon is filled with gas and is then dispensed. In a non-filled state, the foil balloons are stored in the dispensing apparatus preferably in a space-saving manner either in the form of a roll or in a folded state.

The dispensing apparatus includes at least one guide track for accommodating and guiding the adapter part of the foil balloon. Advantageously, a plurality of such adapter parts including foil balloons can be guided in the guide track. It is further possible to arrange in the dispensing apparatus a rotatable magazine with several parallel guide tracks wherein each guide track accommodates a plurality of adapter parts including foil balloons. The various guide tracks are arranged distributed over the circumference of the magazine and can be moved to a dispensing position by rotation of the magazine about its longitudinal axis so that any particular desired foil balloon can be inflated and dispensed. Advantageously, each guide track includes balloons of only the same type. The balloon of different guide tracks may differ for example in size, color, or imprinted designs. This permits the customer to select from different types of foil balloons.

The dispensing apparatus further includes a nozzle which can be connected to a gas reservoir, in particular a gas cylinder which is preferably disposed within the dispensing apparatus but which also may be arranged without the dispensing apparatus. It is also possible to arrange several gas cylinders within the dispensing apparatus, for example five gas cylinders so as to permit a switch over to another gas cylinder when a gas cylinder is empty.

As gas for example helium is used. But another gas such as for example air may also be used. The gas is conducted from the gas reservoir via the adapter part and, if present, the balloon valve into the foil balloon. The nozzle is adjustable by a control drive between an advanced functional position, in which a flow connection to the adapter part is established and a retracted non-functional position, in which the gas flow to the adapter part is interrupted. The nozzle is connected to the gas reservoir preferably by a hose. In the hose or at the gas reservoir a valve may be arranged for controlling the gas flow. Gas is supplied to the interior of the foil balloon only in the advanced functional position of the nozzle to which it is moved by a control drive. In the retracted non-functional position the foil balloon can not be filled with gas.

The nozzle may be movable in two different directions, for example horizontally or vertically, preferably by two different drives. With the horizontal and the vertical movability the nozzle can be moved for example horizontally into the adapter part and vertically, together with the adapter part and the foil balloon, into a position suitable for filling the foil balloon with gas.

As control drive for moving the nozzle between the functional and non-functional positions, for example, a linear motor may be used.

Next to the guide track in the dispensing apparatus at least one ejector ramp may be arranged whose purpose it is to cause, during the movement along the guide track, the release of the still folded foil balloon from engagement by the holding arms of the adapter part, so that the foil balloon can freely unfold when it is inflated by the gas. The at least one ejector ramp, or for example two ejector ramps extend parallel to the guide track and are provided with a ramp-like section which is arranged at an angle with respect to the guide track.

In accordance with a further advantageous embodiment, a barcode is imprinted on the foil balloon with information regarding technical parameters which are specific for the particular foil balloon, for example information concerning the gas pressure and the filling amount. The barcode can be read by a barcode scanner and the respective information can be processed in a control unit and utilized for controlling the gas flow to the balloon.

A further aspect of the invention concerns a method for the operation of the above-described dispensing apparatus. Herein, in a first step, the nozzle is moved from a non-functional position, in which a gas flow connection between the nozzle and the adapter part is established so that the foil balloon can be filled with gas. Then, after completion of the inflation procedure, in a second step, the nozzle is first moved still further into the adapter part and subsequently pulled completely out of the adapter part. The movement of the nozzle further into the adapter part causes a release of the attachment section which is arranged directly on the foil balloon from the guide section which is guided in the guide track of the dispensing apparatus.

The gas-filled foil balloon may be taken for example out of a collection basket arranged at the outside of the dispensing apparatus. The guide section of the adapter part is coupled to the attachment section preferably by a string. After the full return of the nozzle, the guide section slides out of the guide tract so that the guide section can be manually grasped and the foil balloon can be held and guided via the string connection.

The invention will become more readily apparent from the following description of advantageous embodiments with reference to the accompanying drawings.

DESCRIPTION OF PREFERRED EMBODIMENTS

Figure 1:
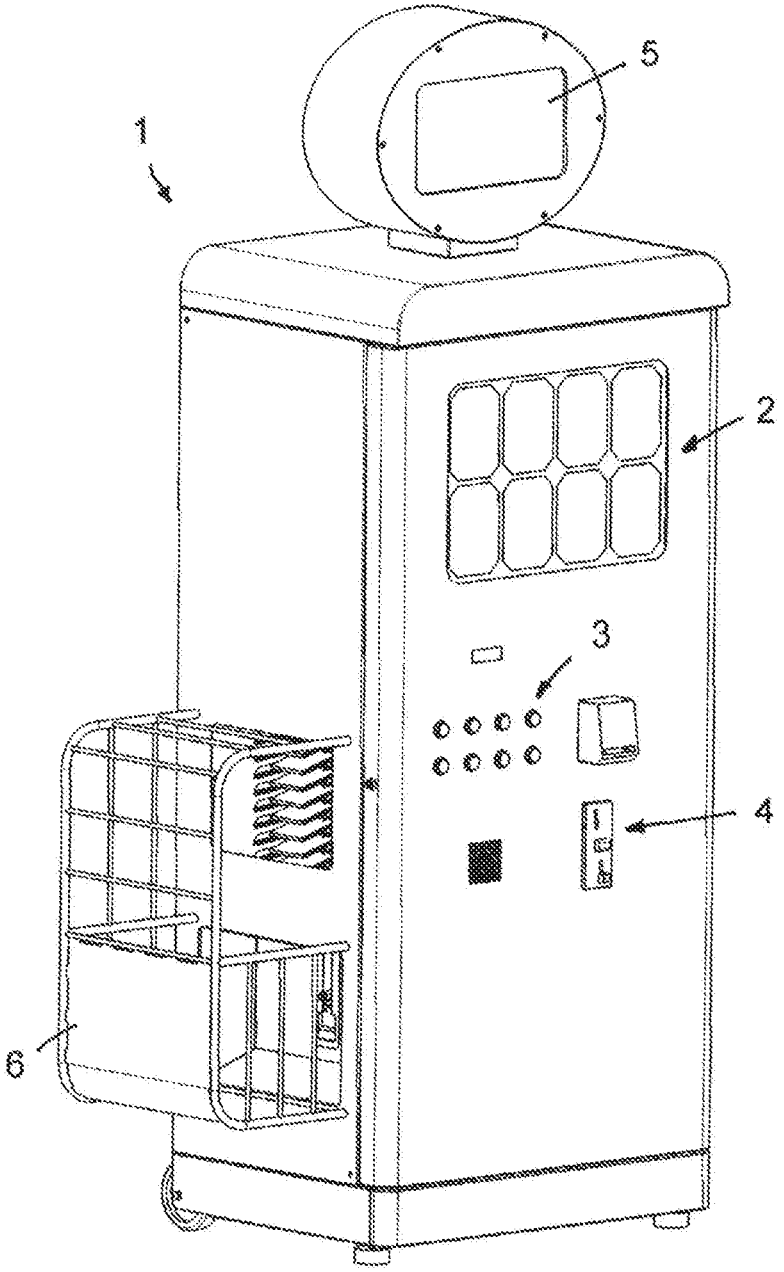
FIG. 1 is a perspective view of a foil balloon dispensing apparatus.

In the various figures identical components are designated by the same reference numerals.

FIG. 1 shows a foil balloon dispensing apparatus 1 for accommodating, filling and dispensing foil balloons. The dispensing apparatus 1 includes a plurality of foil balloons, which may have different colors, shapes, sizes or design imprints and which are deposited in the dispensing apparatus 1 in a non-filled state. The foil balloons have an outer membrane in the form of for example a plastic or aluminum foil. As gas for filling the foil balloons preferably helium is used.

Figure 3:
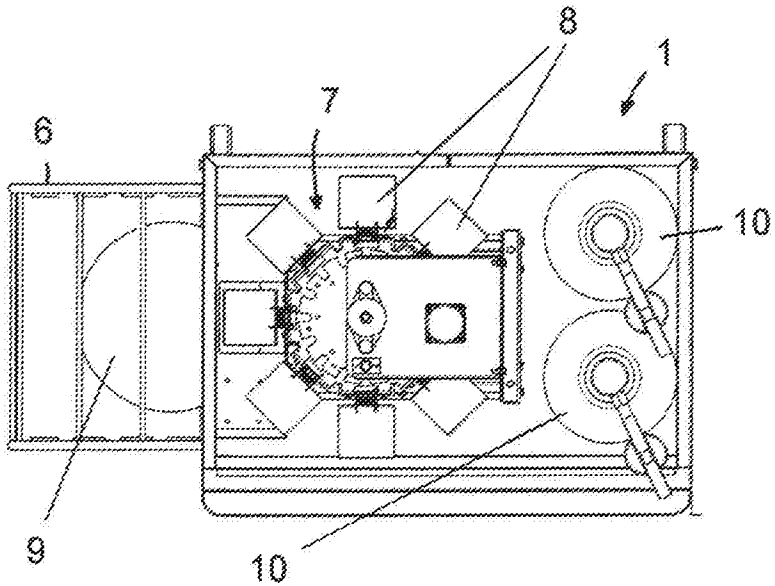
FIG. 3 shows a transverse cross-section of the dispensing apparatus.
Figure 2:
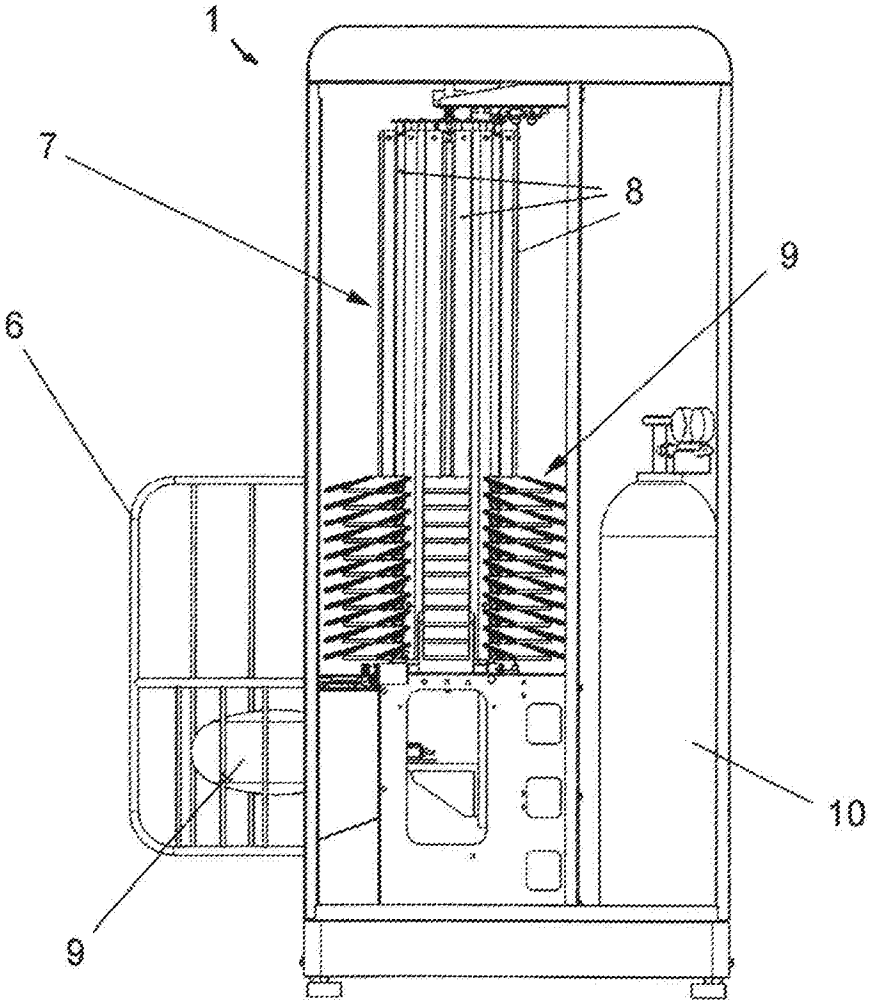
FIG. 2 shows a longitudinal cross-section of the dispensing apparatus.
Figure 4:
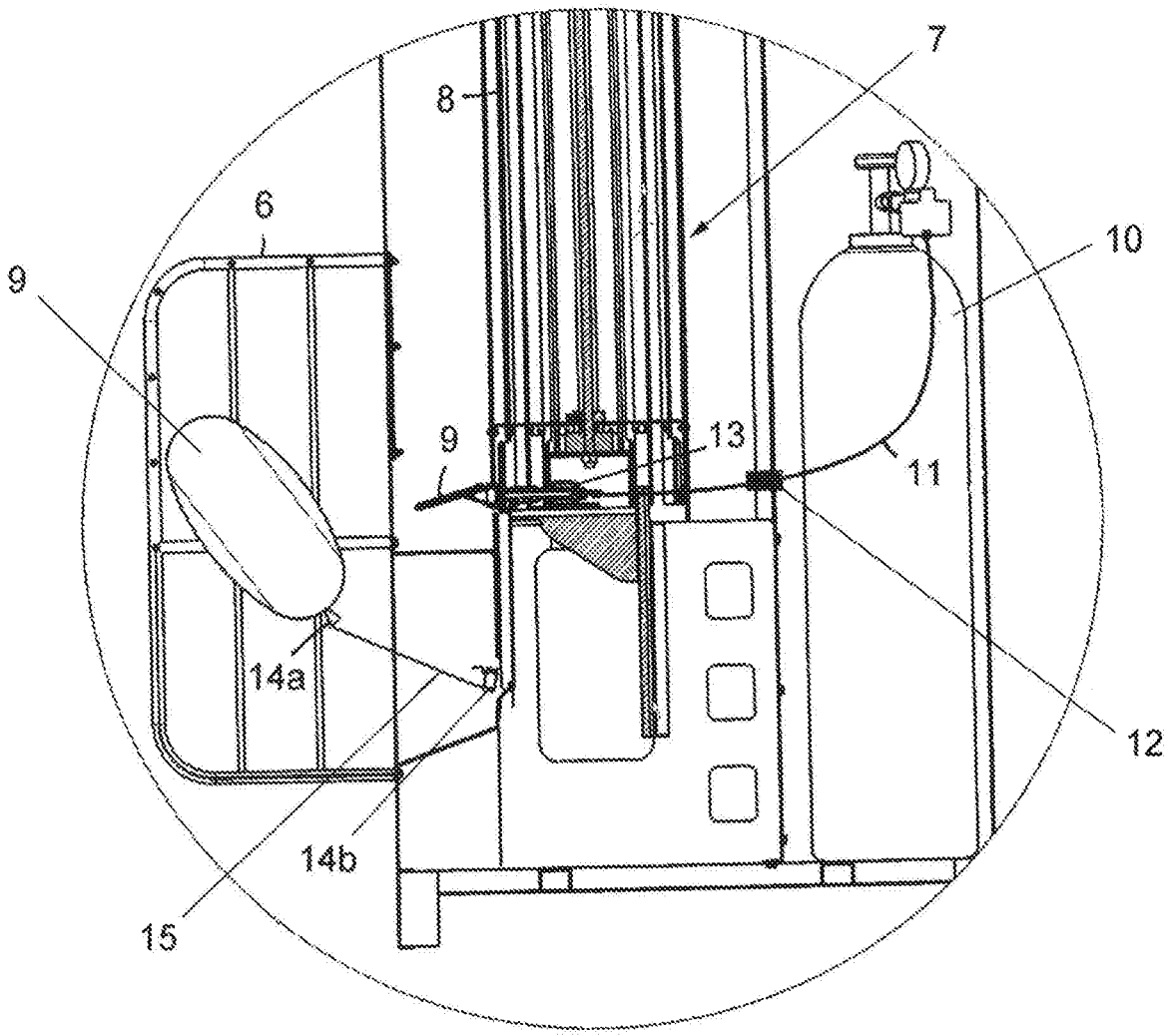
FIG. 4 shows a section, enlarged, in a longitudinal cross-section of the dispensing apparatus in the area of a nozzle for filling a foil balloon.
Figure 5:
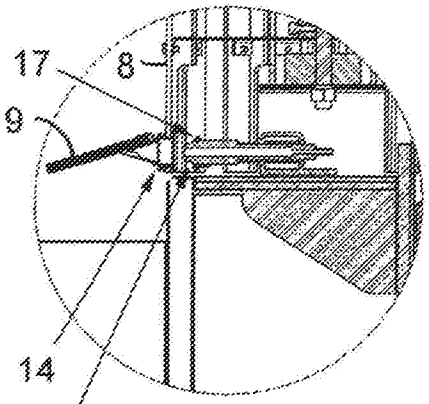
FIGS. 5 to 10 are enlarged sectional views of the dispensing apparatus during the inflation of the foil balloon.
Figure 6:
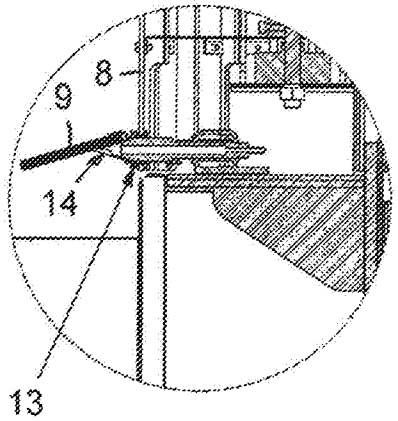

The dispensing apparatus 1 is provided with a visual product display 2 and a selection display 3 as well as a money insertion arrangement 4. Above the money insertion arrangement 4, there is an arrangement for payment by credit or charge cards. By way of the selection display 3 a desired product as shown in the product display 2 can be selected. Optionally, a monitor 5 may be arranged on the dispensing apparatus 1. On the side of the dispensing apparatus 1 there is a collection basket 6 into which the filled foil balloons are released via a dispensing opening formed in the dispensing apparatus 1. FIGS. 2 to 4 show a gas-filled foil balloon 9 disposed in the collection basket 6.

The design of the dispensing apparatus 1 is shown in greater detail in FIGS. 2 to 4. In the dispensing apparatus 1 there is a magazine 7 which is rotatable about a vertical axis and includes, distributed about its circumference, a plurality, for example eight, guide tracks 8, in each of which a plurality of foil balloons 9 are arranged in a folded state. The foil balloons 9 may be different in different guide tracks 8.

In the dispensing apparatus are furthermore two gas cylinders 10 arranged which are filled with helium. Each of the gas cylinders 10 is connected via a hose 11, which includes a valve 12, with a nozzle 13 (FIG. 14) via which the foil balloons 9 are inflated. After one gas cylinder 10 is empty the second gas cylinder 10 can be placed in service via the valve 12. When a foil balloon has been inflated by gas from the gas cylinder 10 the inflated foil balloon 9 is released and can be removed from the collection basket 6.

Each foil balloon 9 is provided with an attachment section 14*a* of an adapter part 14, which attachment section 14*a* is connected via a string 15 to a guide section 14*b* of the adapter part. The guide section 14*b* can be manually grasped in order to hold the inflated balloon and to carry it.

Figure 7:
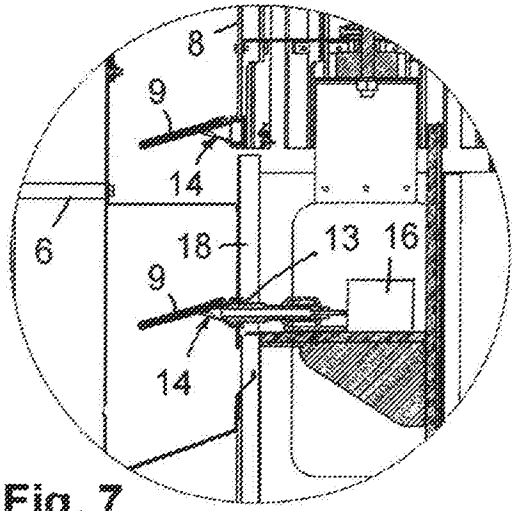

FIGS. 5 to 10 illustrate the various steps of the filling procedure for inflating the foil balloon 9 in the dispensing apparatus 1. The nozzle 13 is vertically and horizontally movable by means of a symbolically represented adjustment drive 16 (FIG. 7). In the retracted non-functional position, the nozzle 13 is disposed at a distance from the foil balloons 9 which are arranged in rows in the guide tracks 8. After a selection is made, the magazine 7 is rotated about its longitudinal axis and the nozzle is moved by its adjustment drive 16 horizontally out of its non-functional position (FIG. 5) to the advanced position (FIG. 6) until the tip of the nozzle 13 projects into the guide section of the adapter part 14. At the outer circumference of the tip of the nozzle 13 there is a seal ring 17 (FIG. 5) which ensures a flow-tight connection between the nozzle 13 and the adapter part 14 in the functional position of the nozzle 13.

Figure 8:
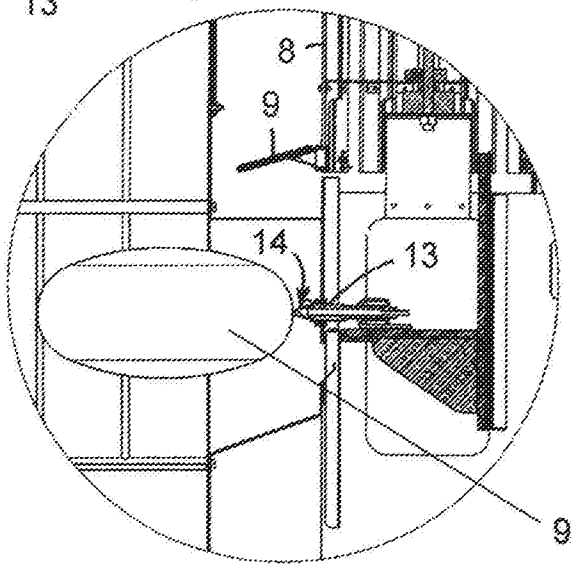

After the nozzle 13 is engaged in the adapter part 14, the nozzle 13 together with the adapter part 14 and the foil balloon 9 are moved vertically downwardly into a further track 18 by a further activation of the adjustment drive 16 so that the foil balloon is now in a position at the level of the collection basket 6. Then the valve 12 of the gas cylinder is opened so that gas flows from the gas cylinder via the hose and the nozzle 13 and the adapter part 14 into the foil balloon 9 and unfolds the balloon while inflating it (FIG. 8).

Figure 9:
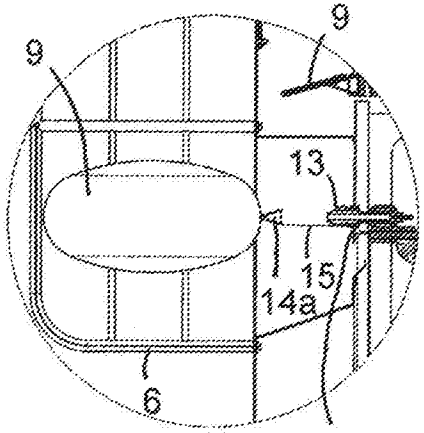

In a further step as shown in FIG. 9, the nozzle 13 moves forward with a jolt into the adapter part 14 whereby the attachment section 14*a* of the adapter part 14 is disconnected from the guide section 14*b*. The connection between the attachment section 14 and the guide section 14*b* includes a breaking point which is broken by the jolt-like movement of the nozzle 13 into the adapter part 14 while the guide section 14*b* remains on the nozzle 14 because it is held in the guide track. The two sections 14*a* and 14*b* however are still interconnected by the string 15.

Figure 10:
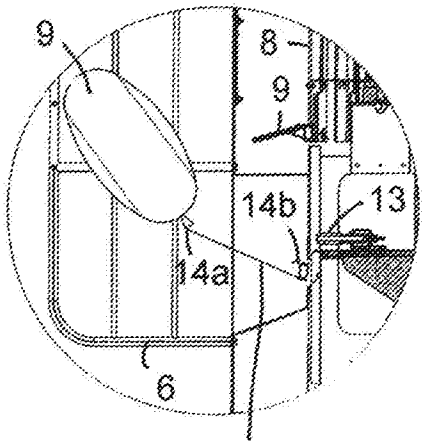

In a last step as shown in FIG. 10 the nozzle 13 is fully retracted into its non-functional position whereby also the guide section 14*b* is removed from the nozzle 13 and can slide downwardly out of the guide track 8 so that the foil balloon 9 can be taken out of the collection basket. The annular guide section can be used for grasping and guiding the foil balloon 9.

Figure 11:
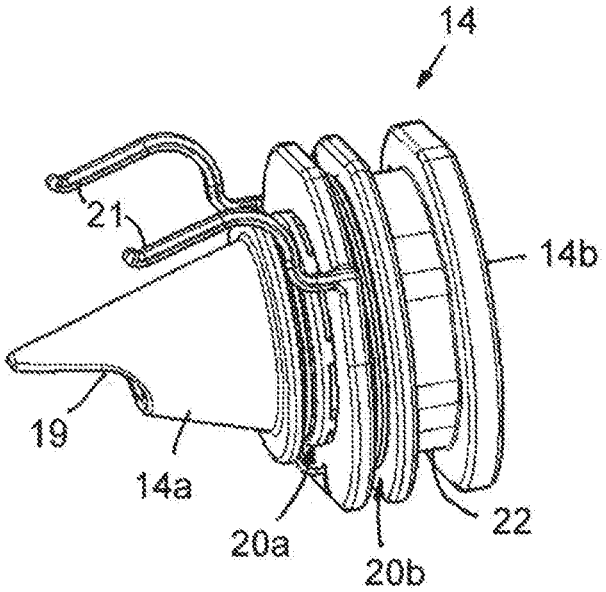
FIG. 11 shows an adapter part in a perspective view, with an attachment section for the attachment to a foil balloon and a guide section for guidance in the guide track in the dispensing apparatus.
Figure 12:
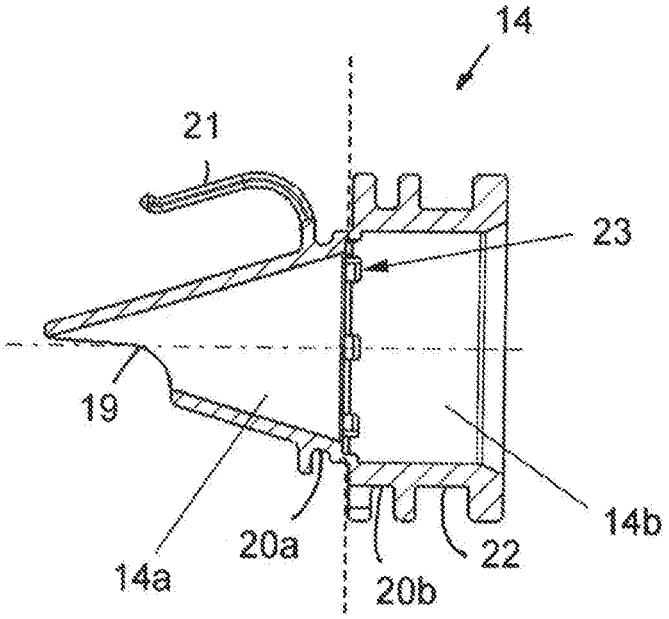
FIG. 12 is a cross-sectional view of the adapter part of FIG. 11.
Figure 13:
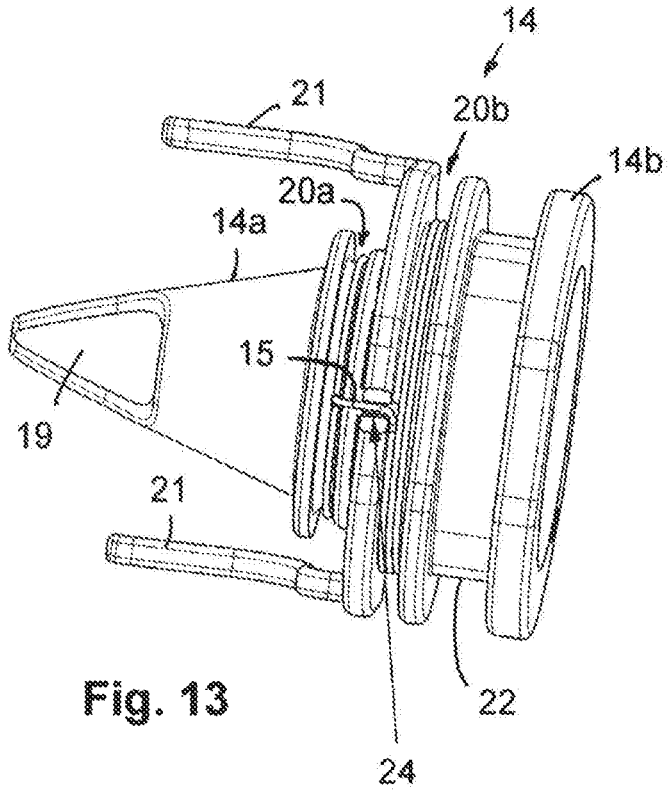
FIG. 13 is another perspective view of the adapter part.
Figure 14:
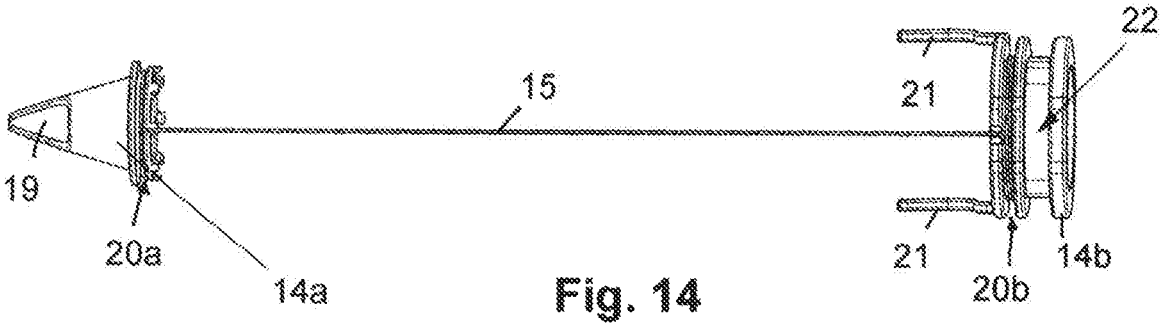
FIG. 14 shows the adapter part with the attachment section and the guide section in a disconnected state but joined by a string.

FIGS. 11 to 13 show an adapter part 14 with the attachment section 14*a* and the guide section 14*b* interconnected whereas FIG. 14 shows the adapter part 14 with the attachment section 14*a* and the guide section 14*b* separated. As shown in the cross-sectional view of FIG. 12, both sections 14*a* and 14*b* are hollow bodies and include an internal passage for conducting the gas from the gas reservoir via the guide section 14*b* and the attachment section 14*a* into the foil balloon 3. The attachment section 14*a* is cone-shaped and narrows down toward the discharge tip thereof. Adjacent the tip of the attachment section 14*a* there is a discharge opening 19 for discharging the gas.

At the outside of the conical attachment section 14*a* there is a wind-up groove 20*a* for accommodating the string 15. The wind-up groove 20*a* is arranged adjacent the guide section 14*b* which is also provided with a wind-up groove 20*b* so that the two wind-up grooves 20*a* and 20*b* of the two sections are positioned adjacent one another. While the foil balloon is stored in the dispensing apparatus the string 15 is wound up in the two wind-up grooves 20*a* and 20*b*.

The attachment section 14*a* is further provided with two retaining arms 21 which are parallel to each other and each extends from a wall that delimits the wind-up groove 20*a*. The two retaining arms are provided to hold the foil balloon in its folded or rolled-up state on the surface of the conical attachment section 14*a*. The two retaining arms are curved or, respectively, bent. With the introduction of gas into the foil balloon, the foil balloon is released from the engagement by the holding arms 21.

The guide section 14*b* has an annular shape. It is provided with an annular circumferential guide groove 22 via which the adapter part 14 is guided in the dispensing apparatus 1 in the guide track 8. The guide groove 22 facilitates the sliding of the adapter part 14 including the folded or rolled-up foil balloon 9 in one of the guide tracks along the guide track.

The attachment section 14*a* and the guide section 14*b* are a plastic component formed integrally in a common manufacturing process. They are joined by the breaking point 23. The breaking point by which the sections 14*a* and 14*b* are joined facilitates the disconnection of the two sections 14*a* and 14*b* when a sufficiently large separating force is applied to the sections 14*a* and 14*b* to separate them. This occurs—as described earlier—when, after inflation of the foil balloon, the nozzle 13 is moved so far into the guide section 14*b* that the front end of the nozzle abuts the attachment section 14*a*. Since the guide section 14*b* is held in the guide track, the impact of the nozzle results in a breaking of the breaking point 23 and the disconnection of the attachment section 14*a* from the guide section 14*b*.

FIGS. 13 and 14 show another embodiment of the adapter part 14 wherein the holding arms 21 are part of the guide section 14*b*. The two holding arms 21 extend in this case from outer wall delimiting the wind-up groove 20*b*.

It is furthermore shown in FIG. 13 that the front wall delimiting the wind-up groove 20*b* is provided with a connecting groove 24 through which the string 15 extends. The string 15 is wound up partially in the wind-up groove 20*a* of the attachment section 14*a* and partially in the wind-up groove 20*b* of the guide section 14*b*. The connecting groove 24 extends in axial direction and establishes a path between the wind-up grooves 20*a* 20*b* which accommodate the string 15.

Figure 15:
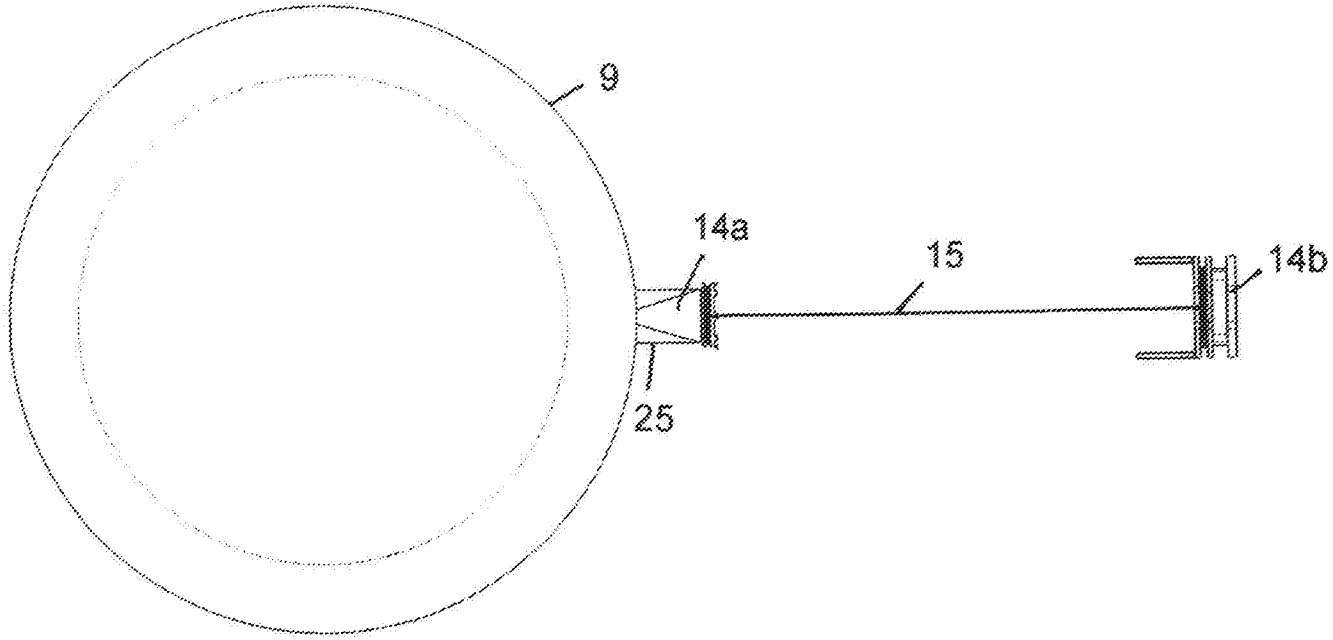
FIG. 15 shows a foil balloon with attachment section and a guide section of the adapter part disconnected from the attachment section.

FIG. 15 shows the attachment section 14*a* of the adapter part 14 and the guide section 14*b* separated from each other but interconnected by the string 15 with the foil balloon connected to the attachment section 14*a*. The attachment section 14*a* extends into a balloon valve 25 which is part of the foil balloon 9 and via which the foil balloon has been inflated. Without the pressure of the supply gas flowing into the balloon the valve 25 is closed to prevent deflation of the foil balloon.

Figure 16:
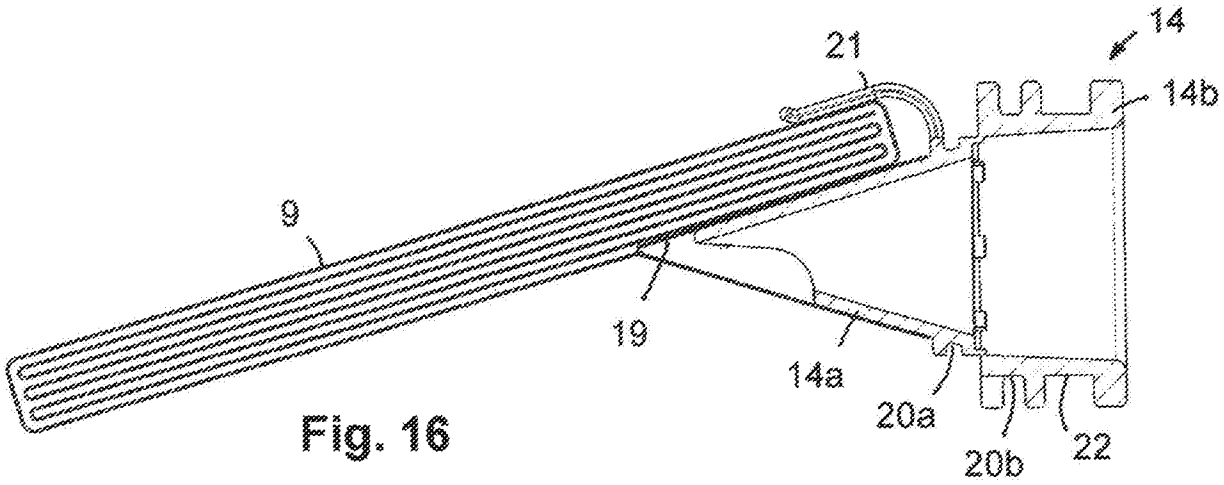
FIG. 16 shows a folded foil balloon on the adapter part in a longitudinal cross-sectional view.
Figure 17:
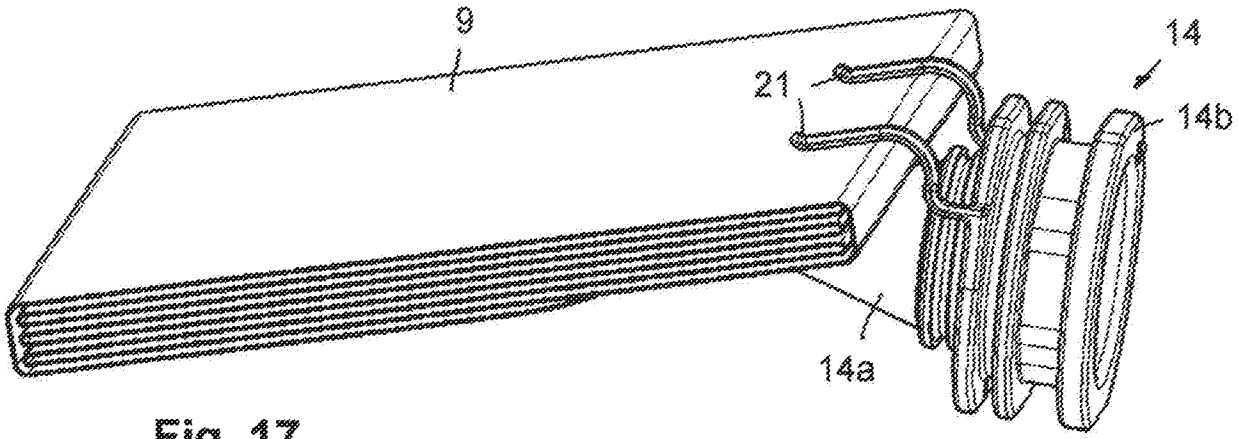
FIG. 17 shows the folded foil balloon connected to the adapter part in a perspective view.

FIGS. 16 and 17 show the connection between the foil balloon 9 and the adapter part 14 during storage of the folded foil balloon in the dispensing apparatus. The foil balloon is folded several times, in particular with a combination of longitudinal and transverse folds. In this form, it is clamped by the two retaining arms 21 which extend from the attachment section 14*a* in such a way that a part of the foil balloon 9 abuts the outer surface of the cone-shaped attachment section 14*a*.

Figure 18:
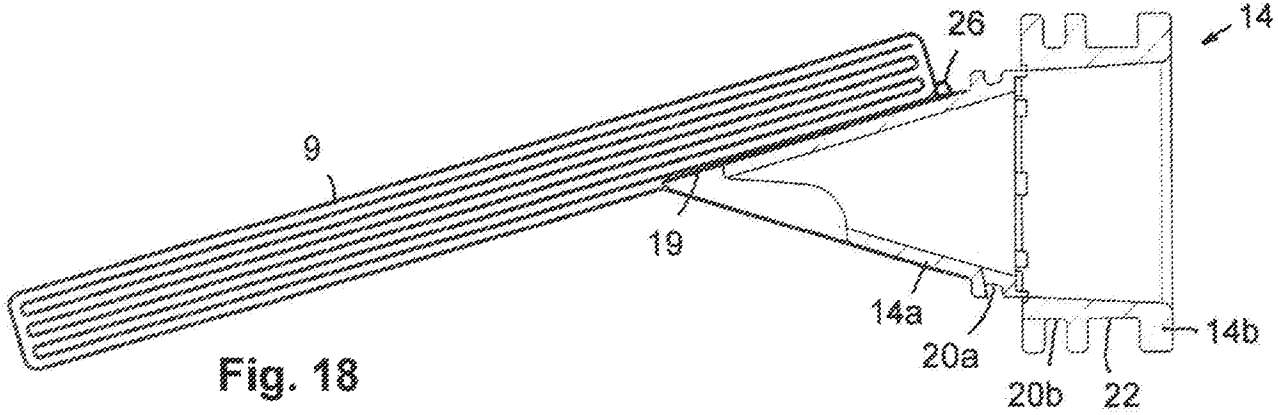
FIGS. 18 and 19 are cross-sectional and perspective views of a folded foil balloon including the adapter part with attachment of the foil balloon to the attachment section in a different embodiment.
Figure 19:
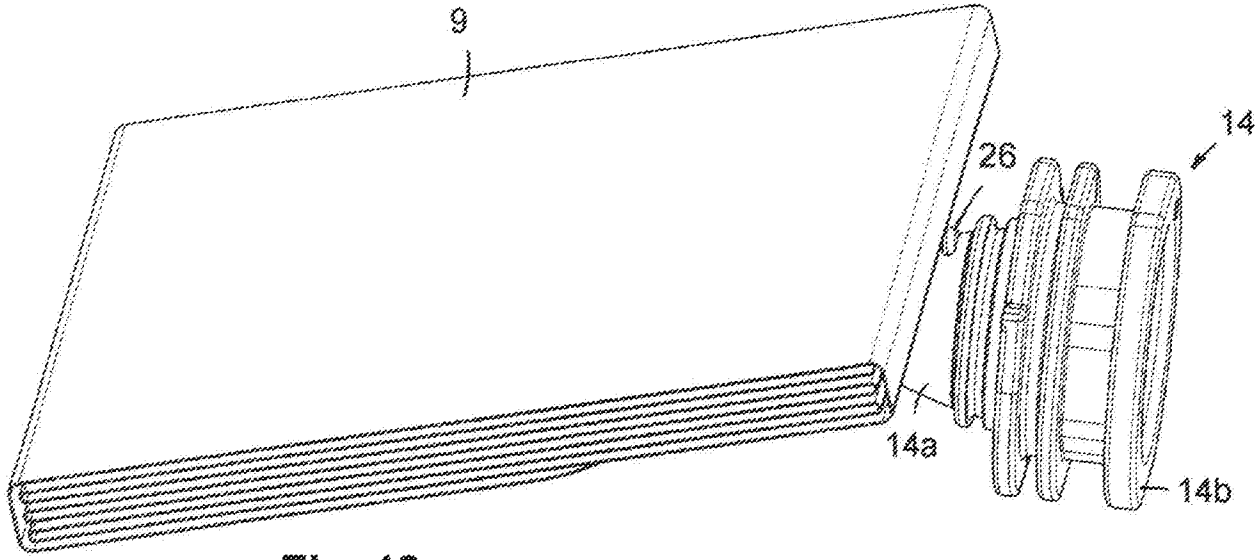

In the embodiment of FIGS. 18 and 19 the folded foil balloon 9 is attached to the outer surface of the cone-shaped attachment section 14*a* by a cement. Holding arms are not needed in this embodiment. The cement may be provided as a connecting spot or a connecting stripe. The attachment force which is generated by the cement 26 is of a strength which prevents a release of the foil balloon 9 from the attachment section 14*a* during inflation of the balloon.

By an additional application of cement, particularly in the form of a spot application, a section of the foil balloon 9 which is disposed directly on the cone of the attachment section 14*a* and cemented thereto may be cemented to additional layers of the foil balloon in order to secure the foil balloon in its folded state. Upon inflation of the foil balloon 9 the cemented spots 26 are ripped as the foil balloon is unfolded.

Figure 20:
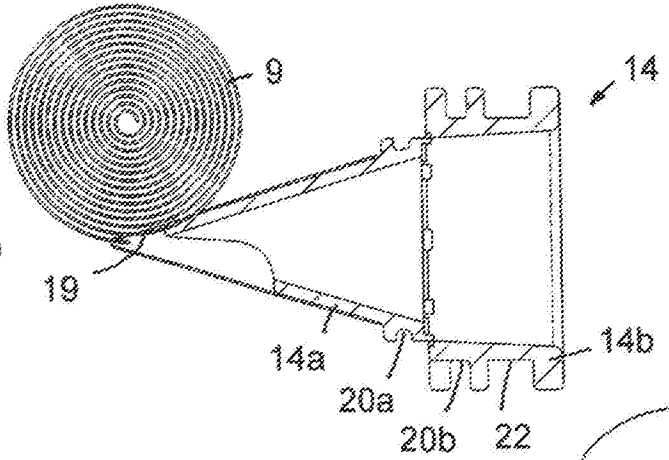
FIG. 20 shows a rolled-up foil balloon connected to an adapter part in a cross-sectional view.
Figure 21:
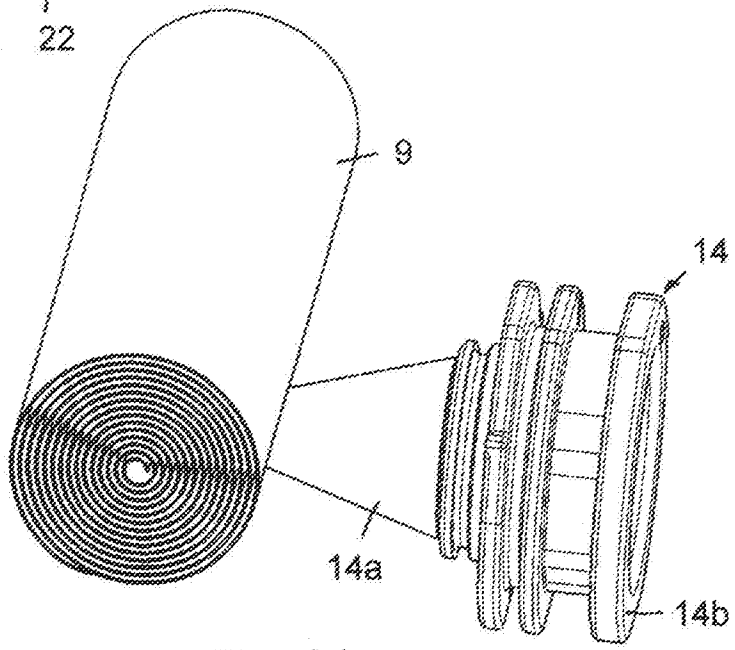
FIG. 21 is a perspective view of the rolled-up foil balloon including the adapter part.
Figure 22:
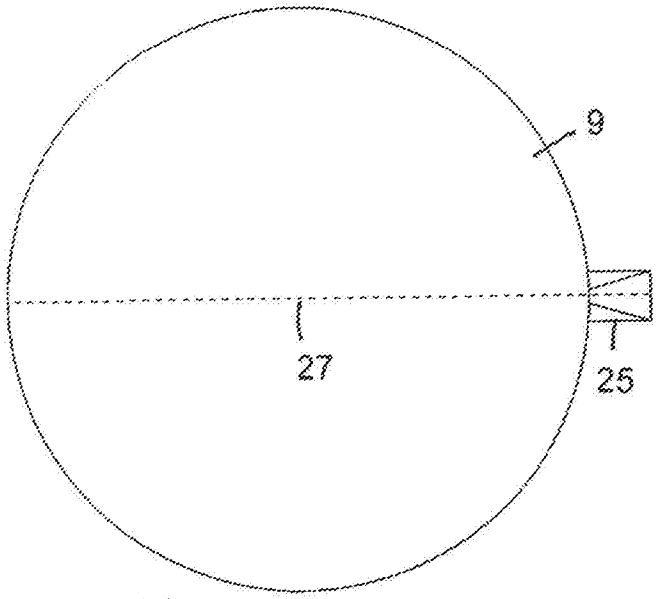
FIG. 22 shows a foil balloon with a balloon valve and an internal spiral for fixing the foil balloon in a rolled-up state.

In the embodiment according to FIGS. 20 to 22 the foil balloon is rolled up and is held in the rolled-up state on the attachment section 14*a* by a thin spiral wire 27 which is cemented to the foil balloon 9 at the inside thereof. Upon inflation of the foil balloon the spiral wire 27 is rolled off so that the foil balloon 9 can be unrolled and released.

Figure 23:
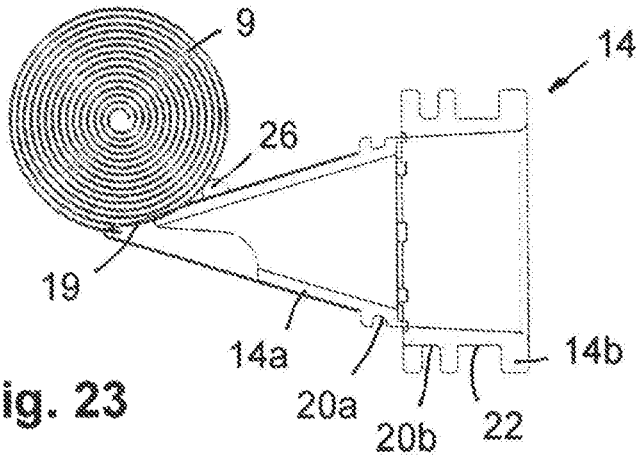
FIGS. 23, 24 show a rolled-up foil balloon which is fixed to an adapter part via a cementing spot.
Figure 24:
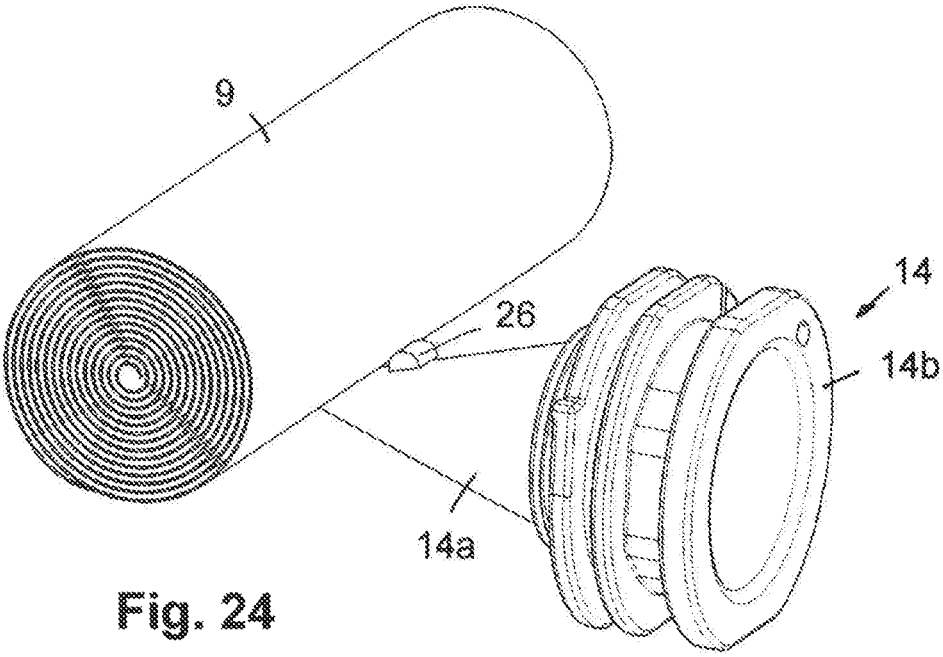

The foil balloon 9 is rolled up also in the exemplary embodiment shown in FIGS. 23 and 24. The foil balloon 9 is attached to the surface of the conical attachment section 14*a* by a cement 26. The cement 26 may be applied in the form of a spot or a stripe or it may be applied to a certain surface area.

Figure 25:
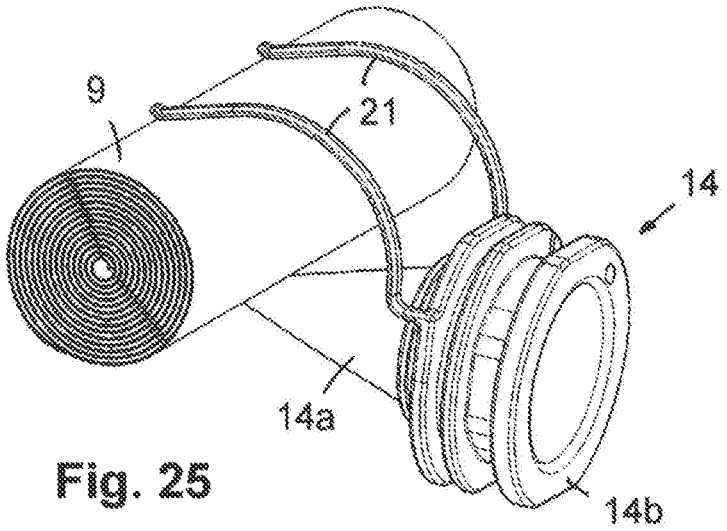
FIG. 25 shows a rolled-up foil balloon engaged by the adapter part via two retaining arms.

In the exemplary embodiment according to FIG. 25 the adapter part 14 is provided with two bent holding arms 21 which extend parallel to one another and which hold the rolled-up foil balloon 9 and press it against the outer surface of the cone-shaped attachment section 14*a*.

Figure 26:
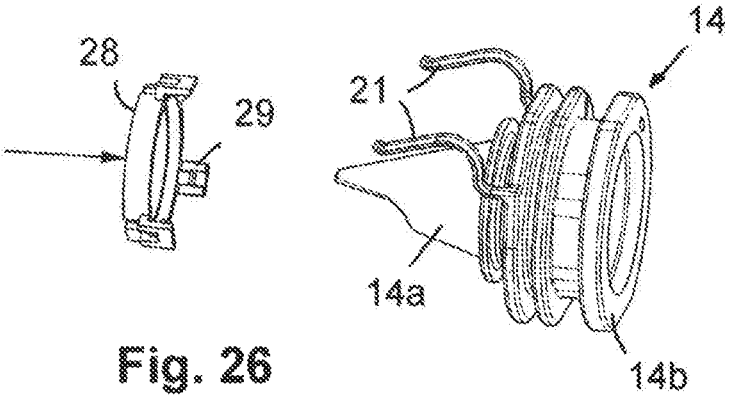
FIG. 26 shows an adapter part with a clamping ring for fixing the foil balloon to the adapter part.
Figure 27:
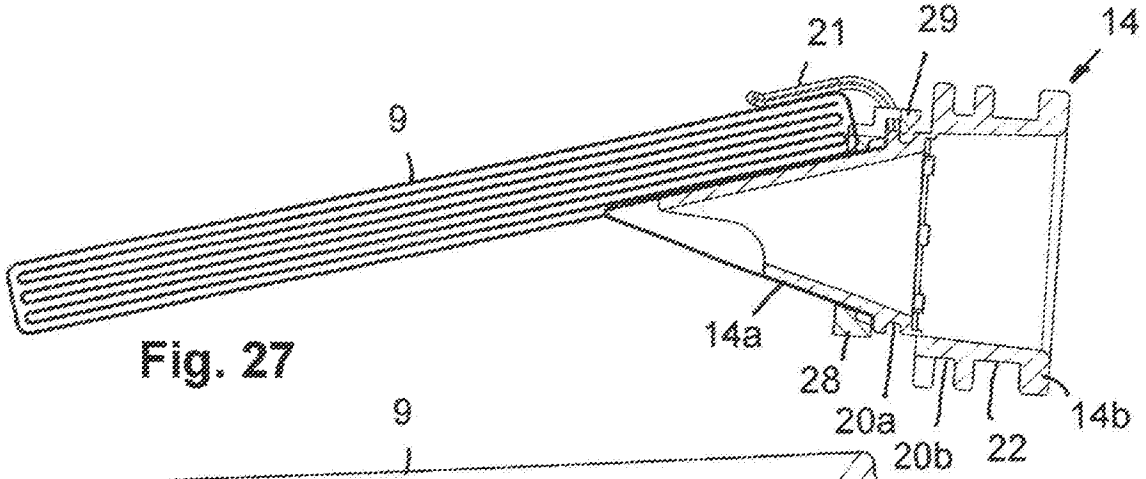
FIGS. 27, 28 show a folded balloon which is fixed to the adapter part by retaining arms and a clamping ring, shown in a cross-sectional and, respectively, a perspective view.
Figure 28:
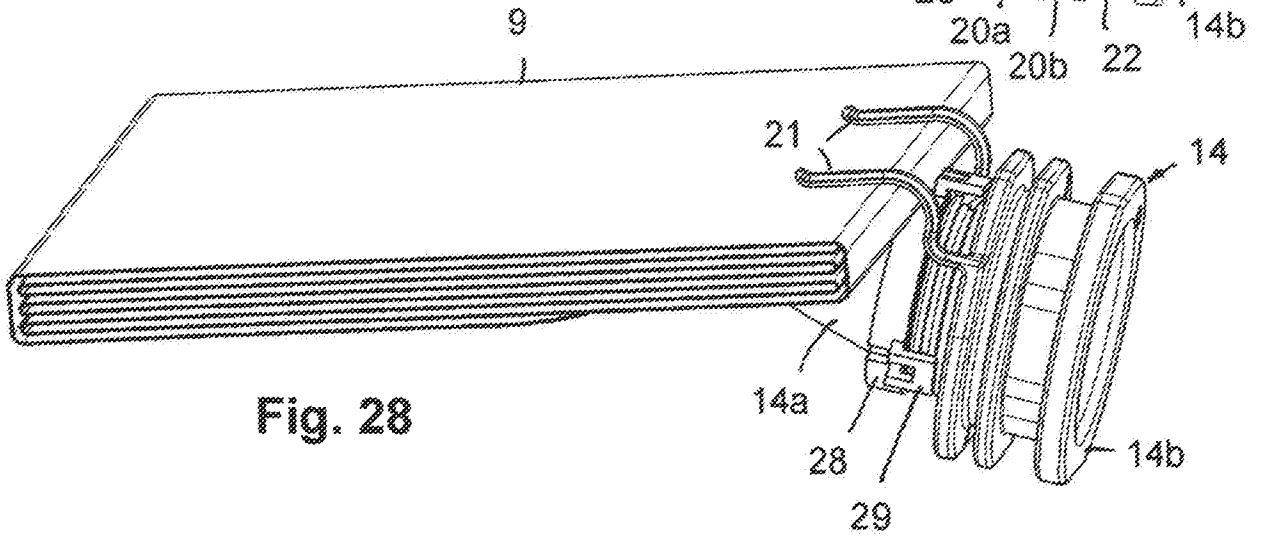

In FIGS. 26 to 28 a further exemplary embodiment is shown wherein a clamping ring 28 is used for connecting the foil balloon 9 to the adapter part 14. The clamping ring 28 is moved over the balloon opening of the foil balloon 9 whereupon the adapter part 14 is inserted into the balloon opening and the clamping ring 28 is locked to the adapter part 14. To this end the clamping ring 28 is provided with clamping projections 29 which are distributed over the circumference of the clamping ring 28 and project axially beyond the clamping ring 25 and over the groove wall which delimits the wind-up groove 20*a* at the outside of the conical attachment section 14*a* for retaining the clamping ring 28 in its mounted position. Additionally, the adapter part 14 has two retaining arms 21 which clampingly retain the folded foil balloon 9.

Figure 29:
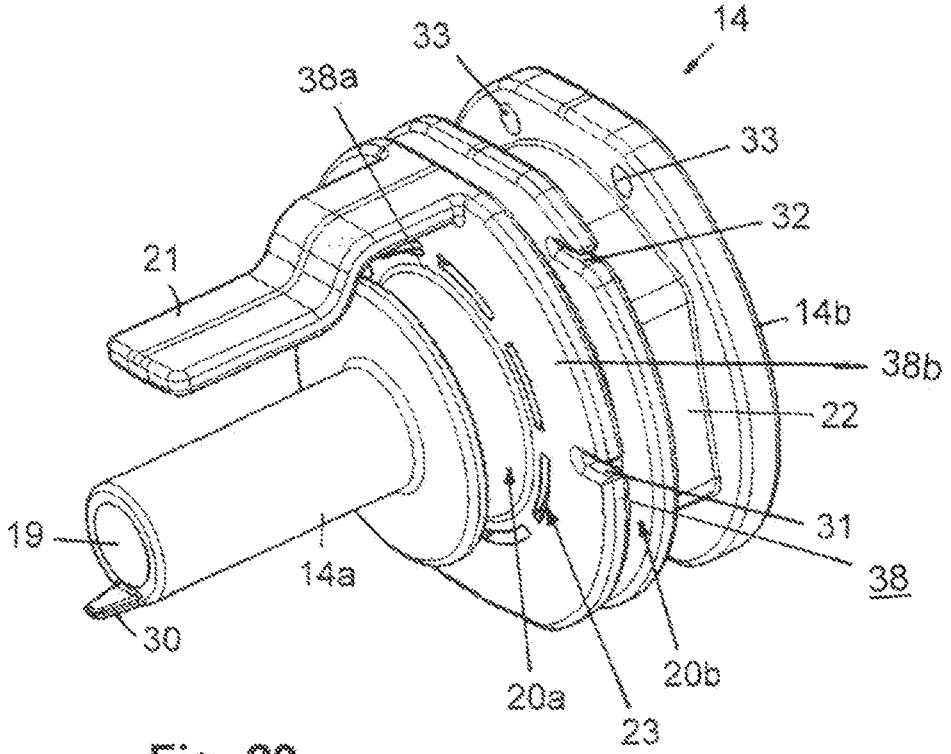
FIG. 29 shows a further embodiment of an adapter part in a perspective view.
Figure 30:
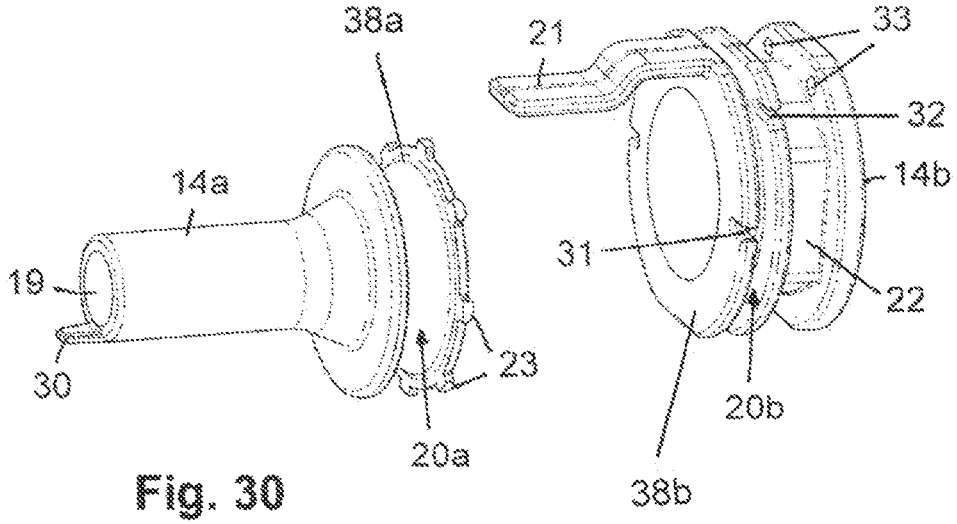
FIG. 30 shows the adapter part of FIG. 29 with an attachment section and a guide section separated from each other.

FIGS. 29 and 30 show an embodiment of an adapter part 14 consisting of an attachment section 14*a* and a guide section 14*b*. Herein the attachment section 14*a* has a hollow cylindrical flow guide element with a discharge opening 19 at the front end thereof for the gas to be supplied to the foil balloon. The front end is provided with an axial projection 30 in the form of a prong. The projection 30 is formed integrally with the flow guide element of the attachment section 14*a* and forms an insert aid for facilitating insertion of the cylindrical flow element into an inflow opening of the foil balloon.

FIG. 29 also shows the breaking point or area 23 which in this case is circular and is formed on a side wall 38 between the wind-up groove 20*a* which is part of the attachment section 14*a* and the wind-up groove 20*b* which is part of the guide section 14*b*. The breaking area 23 extends circularly on the side wall 38. With the breakage of the breaking area and the removal of the attachment section 14*a* from the guide section 14*b* (FIG. 30), the axially limiting walls 38*a*, 38*b* of the wind-up grooves 20*a* and 20*b* remain in place.

In the shown exemplary embodiment only one engagement arm 21 is shown provided on the adapter part 14, which engagement arm 21 extends from the guide section at least approximately in axial direction. The engagement arm 21 is arranged spaced from the flow guide element of the attachment section 14*a* and parallel thereto. The folded foil balloon can be clamped that is held between the flow guide element of the attachment section 14*a* and the engagement arm 21.

The two delimiting walls of the wind-up groove 20*b* on the guide section 14*b* are provided with notches 31 and 32 for accommodating the string 15 by which the attachment section 14*a* and the guide section 14*b* are interconnected. The notches 31 and 32 are arranged angularly displaced. A further wall of the guide section 14*b* which delimits the guide groove 22 is provided with openings 33 permitting an attachment of the string.

Figure 31:
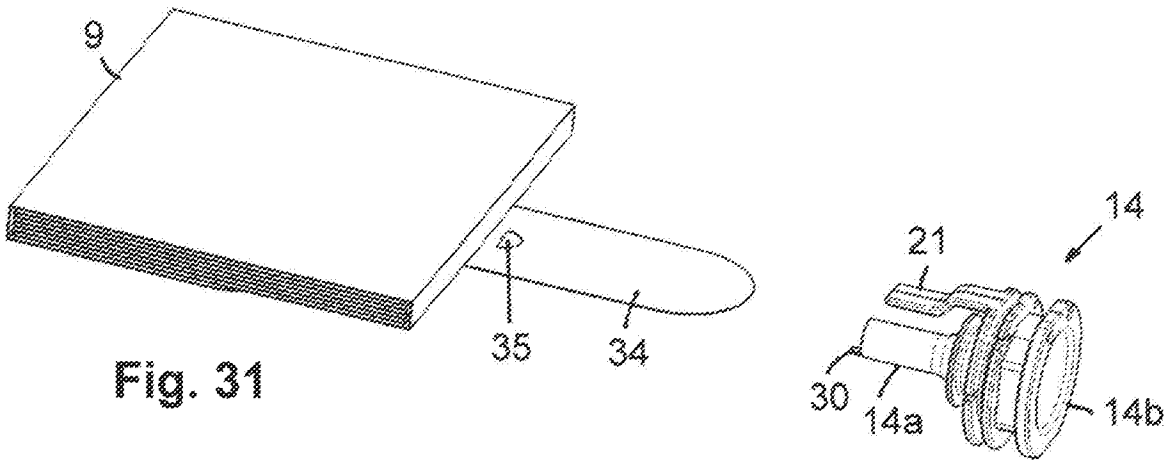
FIG. 31 shows a folded foil balloon including a balloon strap for attachment to an adapter part, according to FIGS. 29 and, respectively 30.
Figure 32:
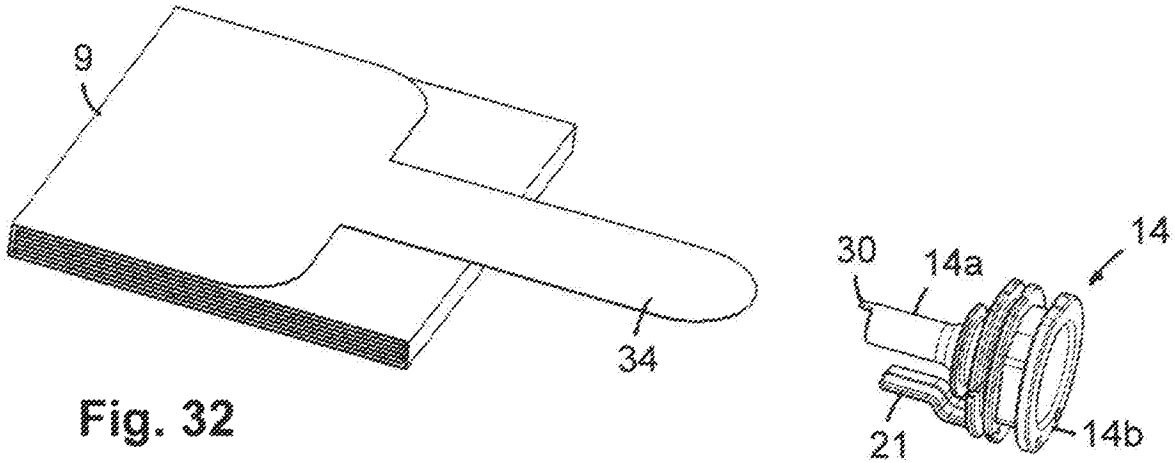
FIG. 32 is a representation as shown in FIG. 31 however seen from an opposite direction.

FIGS. 31 and 32 each show a folded foil balloon 9 including an adapter part 14, wherein each foil balloon 9 is provided with a balloon strap 34. The balloon strap 34 is formed integrally with the foil balloon 9. The balloon strap 34 may be used for the attachment of the foil balloon 9 to be adapter part 14, in particular via the string 15 as it is shown in FIGS. 33 and 34.

The balloon strap 34 may be provided with an inflow opening 35 of the foil balloon (FIG. 31) via which the foil balloon can be inflated.

Figure 33:
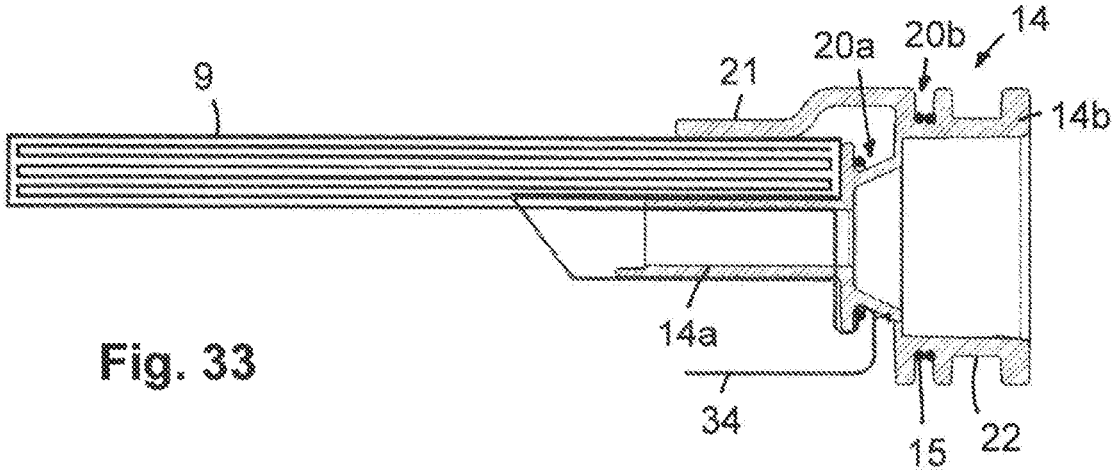
FIG. 33 is a longitudinal cross-sectional view of a folded foil balloon with a balloon strap and an adapter part as shown in FIGS. 29 and, respectively, 30.
Figure 34:
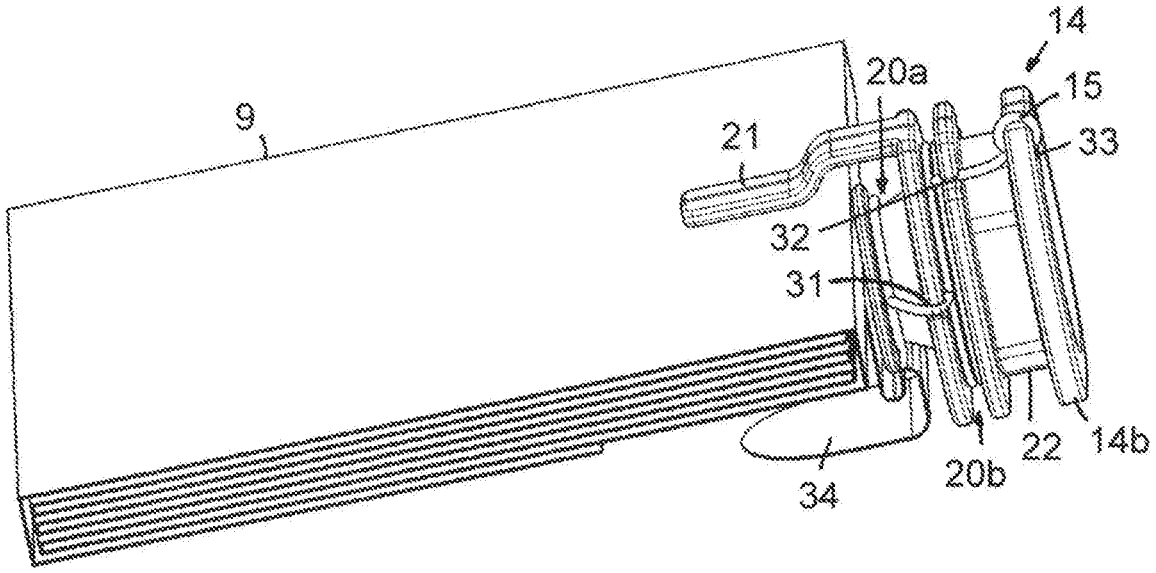
FIG. 34 shows the set-up as shown in FIG. 3 in a perspective view.

The representations of FIGS. 33 and 34 correspond to those of FIGS. 16 and 17 except that in FIGS. 33 and 34 an adapter part as shown in FIGS. 29 and 30 is used. Furthermore, the foil balloon 9 includes the balloon strap 34 which has been described above and which is attached to the attachment section 14*a* in the wind-up groove 14*a* via the string 15. The string 15 extends through the notches 31 and 32 and is fixed at one of the openings 33 which are provided in the guide section 14*b*. The single engagement arm 21 abuts the top side of the folded foil balloon and presses the foil balloon 9 against the flow component of the attachment section 14*a* disposed below.

Figure 35:
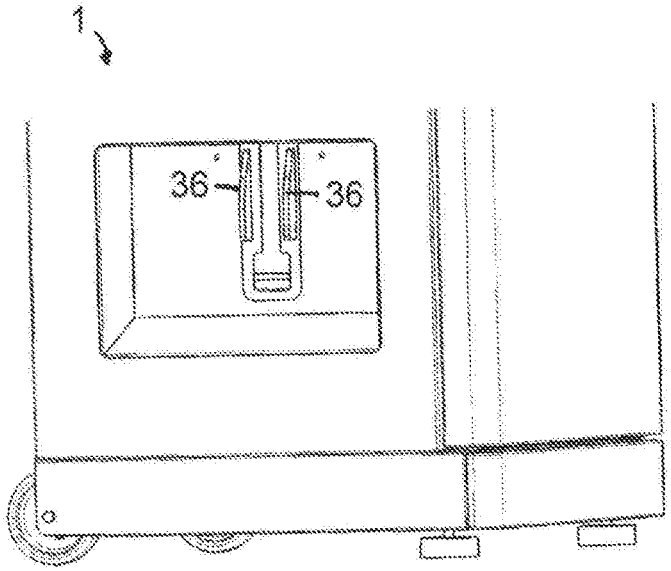
FIG. 35 is a perspective partial view of a foil balloon dispensing apparatus with two parallel dispensing ramps.
Figure 36:
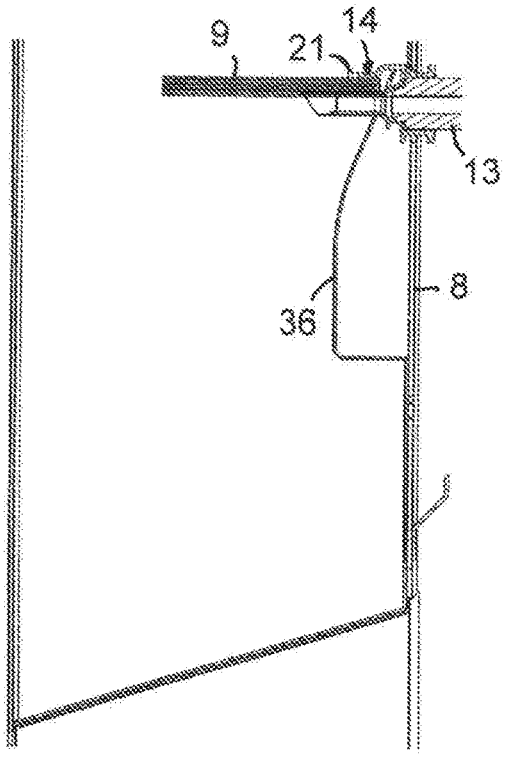
FIG. 36 shows a cross-section of the dispensing apparatus taken at the level of the dispensing ramps with a folded balloon in a position above the dispensing ramps.
Figure 37:
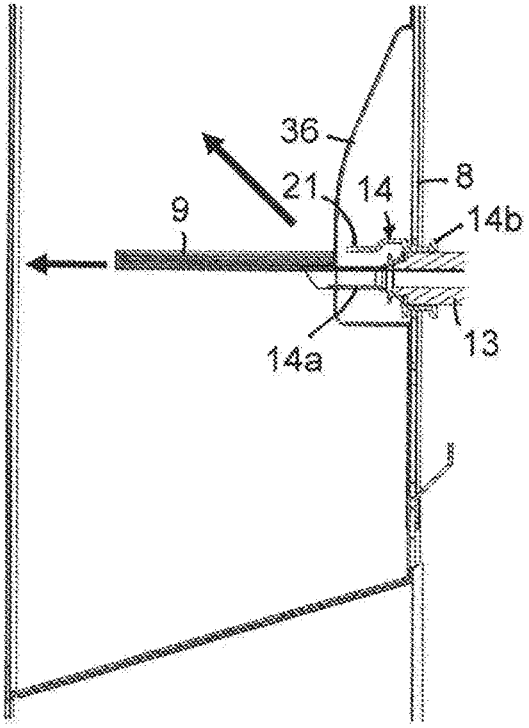
FIG. 37 is a view like FIG. 36 but with a folded balloon in a downwardly displaced position.

FIGS. 35 to 37 show sections of the dispensing apparatus 1, which, in the area of the guide track 8, is provided with two parallel dispenser ramps. The two dispenser ramps 36 are provided in order to pull, during downward movement of the adapter part 14 including the nozzle 13, the folded packet of the foil balloon 9 sidewardly out of the attachment section 14*a* so as to facilitate a subsequent unfolding of the foil balloon during its inflation. By this sideward displacement of the foil balloon 9, the foil balloon is removed from the engagement by the holding arm 21 of the adapter part 14 so that the foil balloon is no longer pressed onto the adapter part 14 permitting the free unfolding of the foil balloon.

Figure 38:
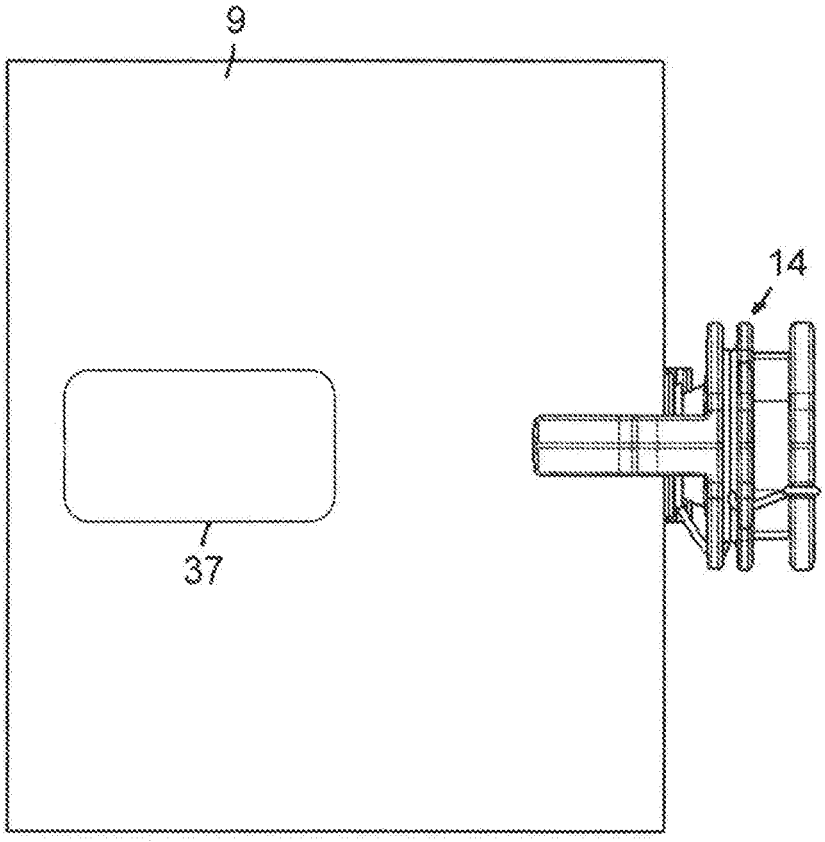
FIG. 38 is a top view of a folded foil balloon on an adapter part, with a barcode imprinted on the foil balloon.

As apparent from the top view as shown in FIG. 38 the folded packet of the foil balloon 9 is provided at its top side with a barcode imprint 37 which contains various technical information, for example the pressure of the inflating gas and the amount of gas, which depend on the type of foil balloon to be inflated. The barcode 37 can be read by a respective code reader disposed in the dispensing apparatus. The information can be processed in a control unit and the gas flow for the inflation of the foil balloon 9 can be controlled accordingly.

LISTING OF REFERENCE NUMBERS

1 foil balloon dispensing apparatus
2 product display
3 selection display
4 money insertion arrangement
5 monitor
6 collection basket
7 magazine
8 guide track
9 foil balloon
10 gas cylinder
11 hose
12 valve
13 nozzle
14 adapter part
14*a* attachment section
14*b* guide section
15 string
16 adjustment drive
17 seal ring
18 track
19 discharge opening
20*a* wind-up groove
20*b* wind-up groove
21 retaining arm
22 guide groove
23 breaking point
24 connecting groove
25 balloon valve
26 cement
27 spiral wire
28 clamping ring
29 clamping projection
30 projection (insertion aid)
31 notch
32 notch
33 opening
34 balloon strap
35 inflow opening
36 dispenser ramp
37 barcode

What is claimed is:

1. A foil balloon adapter part (14) comprising a foil balloon (9) and an attachment section (14*a*) for attachment to the foil balloon (9) and a guide section (14*b*) for guiding the adapter part (14) in a guide track (8) of a foil balloon dispensing apparatus (1) and for receiving a nozzle (13) for the inflation of the foil balloon (9), the attachment section (14*a*) and the guide section (14*b*) being integrally interconnected as a single part and both being in the form of hollow bodies forming an internal flow passage for gas for the inflation of the foil balloon (9), the attachment section (14*a*) having a discharge opening (19) for supplying gas to the foil balloon (9) and the attachment section (14*a*) and the guide section (14*b*) being disconnectable but being still joined by a string (15), wherein the attachment section (14*a*) and the guide section (14*b*) are configured to be broken apart one from the other upon the application of a predetermined breaking force caused by a jolt-like movement of the nozzle (13) moving into the guide section (14*b*) after inflation of the foil balloon (9) and the nozzle (13) impacting the attachment section (14*a*) at a pre-set breaking area (23) of the foil balloon adapter part (14) in operative arrangement between the attachment section (14*a*) and the guide section (14*b*);

wherein the attachment section (14*a*) includes a cone-shaped or cylindrical flow conducting part; and, wherein the adapter part (14) is provided with at least one retaining arm (21) operatively extending in spaced relationship with the cone-shaped or cylindrical flow conducting part, the at least one retaining arm (21) in contacting arrangement with the foil balloon (9) prior to inflation by holding the foil balloon (9) in a folded state in pressed relationship between the at least one retaining arm (21) and an outer surface of the cone-shaped or cylindrical flow conducting part.

2. The foil balloon adapter part (14) according to claim 1, wherein at least one of the attachment section (14*a*) and the guide section (14*b*) is provided with an annular wind-up groove (20*a*, 20*b*) for accommodating the string (15).

3. The foil balloon adapter part (14) according to claim 2, wherein the attachment section (14*a*) includes a first annular wind-up groove (20*a*) and the guide section (14*b*) includes a second annular wind-up groove (20*b*), both the first annular wind-up groove (20*a*) and the second annular wind-up groove (20*b*) for accommodating the string (15), a side wall (38) is provided in operative arrangement between the first annular wind-up groove (20*a*) and the second annular wind-up groove (20*b*), the pre-set breaking area (23) is configured to extend circularly on the side wall (38) and to define a first axially limiting wall (38*a*) for the first annular wind-up groove (20*a*) and to define a second axially limiting wall (38*b*) for the second annular wind-up groove (20*b*) such that upon the breakage at the pre-set breaking area (23) the first axially limiting wall (38*a*) is configured to remain with the first wind-up groove (20*a*) and the second axially limiting wall (38*b*) is configured to remain with the second wind-up groove (20*b*).

4. The foil balloon adapter part (14) according to claim 1, wherein the guide section (14*b*) is provided with an annular guide groove (22) for guidance of the guide section (14*b*) by the guide track (8) of the foil balloon dispensing apparatus (1).

5. The foil balloon adapter part (14) according to claim 1, wherein the attachment section (14*a*) of the foil balloon adapter part (14) is attached to the foil balloon (9), with the discharge opening (19) of the attachment section (14*a*) being adapted to be brought in a flow connection with the interior of the foil balloon (9).

6. The foil balloon adapter part (14) according to claim 5, wherein a balloon valve (12), in particular a nozzle valve, is arranged on the foil balloon (9), into which balloon valve the attachment section (14*a*) extends.

7. A foil balloon dispensing apparatus with the foil balloon adapter part (14) according to claim 5, including a guide track (8) for accommodating and guiding the foil balloon adapter part (14), and the nozzle (13) which is connectable to a gas reservoir and which is movable by an adjustment drive (16) between a functional position with a flow connection to the foil balloon adapter part (14) and a retracted non-functional position without flow-connection to the foil balloon adapter part (14).

8. The foil balloon dispensing apparatus according to claim 7, including a rotatable magazine (7) with several parallel guide tracks (8) for accommodating each of a plurality of the foil balloons (9).

9. The foil balloon dispensing apparatus according to claim 8, wherein the nozzle (13) is vertically movable.

10. The foil balloon dispensing apparatus according to claim 9, wherein the foil balloon (9) in the folded state is arranged as a folded packet prior to inflation, each of said guide tracks (8) having two parallel dispenser ramps (36) in operative arrangement therewith, each dispenser ramp (36) operatively positioned beside the respective guide track (8), said two parallel dispenser ramps (36) in cooperating arrangement with the at least one retaining arm (21) and configured to pull, during a downward movement of the adapter part (14) including the nozzle (13), the folded packet of the foil balloon (9) in a sideward displacement out of engagement with the at least one retaining arm (21) so that the folded foil balloon (9) is no longer pressed onto the outer surface of the cone-shaped or cylindrical attachment section (14*a*) to permit the free unfolding of the foil balloon (9).

11. The foil balloon dispensing apparatus according to claim 7, wherein the adjustment drive (16) for moving the nozzle (13) between the functional and the non-functional position is a linear drive.

12. A method for operating a foil balloon dispensing apparatus according to claim 7, wherein, for the inflation of the foil balloon (9), the nozzle (13) is moved from the non-functional position to the functional position in which a flow connection to the foil balloon adapter part (14) is established and, after inflation of the foil balloon, the nozzle (13) is propelled further into the foil balloon adapter part (14) to break apart the attachment section (14*a*) from the guide section (14*b*) and the nozzle (13) is then pulled out of the adapter part (14).

* * * * *